US010981223B2

(12) United States Patent
Carozzani et al.

(10) Patent No.: US 10,981,223 B2
(45) Date of Patent: Apr. 20, 2021

(54) METHOD FOR MANUFACTURING AN AMORPHOUS METAL PART

(71) Applicant: The Swatch Group Research and Development Ltd, Marin (CH)

(72) Inventors: Tommy Carozzani, Neuchatel (CH); Yves Winkler, Schmitten (CH); Alban Dubach, Bienne (CH)

(73) Assignee: The Swatch Group Research and Development Ltd, Marin (CH)

( * ) Notice: Subject to any disclaimer, the term of this patent is extended or adjusted under 35 U.S.C. 154(b) by 118 days.

(21) Appl. No.: 15/776,861

(22) PCT Filed: Oct. 11, 2016

(86) PCT No.: PCT/EP2016/074369
§ 371 (c)(1),
(2) Date: May 17, 2018

(87) PCT Pub. No.: WO2017/084807
PCT Pub. Date: May 26, 2017

(65) Prior Publication Data

US 2019/0262896 A1 Aug. 29, 2019

(30) Foreign Application Priority Data

Nov. 18, 2015 (EP) ..... 15195197

(51) Int. Cl.
*B22D 27/04* (2006.01)
*B22D 13/00* (2006.01)
(Continued)

(52) U.S. Cl.
CPC ..... *B22D 27/04* (2013.01); *B22C 9/02* (2013.01); *B22D 13/00* (2013.01); *B22D 15/00* (2013.01);
(Continued)

(58) Field of Classification Search
CPC ..... B22D 27/04; B22D 13/00; B22D 13/101; B22D 15/00; B22D 17/00; B22D 25/026; B22C 9/00; B22C 9/02; B22C 9/04
See application file for complete search history.

(56) References Cited

U.S. PATENT DOCUMENTS

2006/0037361 A1 2/2006 Johnson et al.
2006/0086476 A1 4/2006 Peker et al.
(Continued)

FOREIGN PATENT DOCUMENTS

CH 707 351 A2 6/2014
CN 101164722 A 4/2008
(Continued)

OTHER PUBLICATIONS

English Machine Translation of CH 707351 A2 (Year: 2014).*
(Continued)

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

A method for manufacturing a micromechanical component made of a first material, the first material being a material that can become at least partially amorphous, the method including: a) providing a mold made of a second material, the mold including a cavity forming the negative of the micromechanical component; b) providing the first material and forming the first material in the cavity of the mold, the first material having undergone, at a latest at a time of the forming, treatment allowing the first material to become at least partially amorphous; c) separating the micromechanical component thus formed from the mold.

9 Claims, 1 Drawing Sheet

(51) Int. Cl.

| | |
|---|---|
| ***B22D 17/00*** | (2006.01) |
| ***B22D 25/02*** | (2006.01) |
| ***B22D 15/00*** | (2006.01) |
| ***G04B 17/22*** | (2006.01) |
| ***B22C 9/02*** | (2006.01) |
| *A44C 27/00* | (2006.01) |
| *G04B 15/14* | (2006.01) |
| *G04B 17/28* | (2006.01) |
| *G04B 19/04* | (2006.01) |

(52) U.S. Cl.

CPC ..... *B22D 17/00* (2013.01); *B22D 25/026* (2013.01); *G04B 17/227* (2013.01); *A44C 27/003* (2013.01); *G04B 15/14* (2013.01); *G04B 17/285* (2013.01); *G04B 19/042* (2013.01)

(56) References Cited

U.S. PATENT DOCUMENTS

| | | | |
|---|---|---|---|
| 2013/0148480 | A1 | 6/2013 | Charbon et al. |
| 2013/0163391 | A1 | 6/2013 | Helfer et al. |
| 2013/0329533 | A1 | 12/2013 | Winkler et al. |
| 2015/0159249 | A1 | 6/2015 | Dubach et al. |

FOREIGN PATENT DOCUMENTS

| | | | |
|---|---|---|---|
| EP | 2 835 698 | A1 | 2/2011 |
| EP | 2 466 394 | A1 | 6/2012 |
| JP | S49-2655 | | 1/1974 |
| JP | S51-126922 | | 11/1976 |
| JP | S54-151508 | A | 11/1979 |
| JP | S58-179558 | A | 10/1983 |
| JP | H10-110 | A | 1/1998 |
| JP | 2013-529779 | A | 7/2013 |
| JP | 2013-533477 | A | 8/2013 |
| JP | 2014-501920 | A | 1/2014 |
| JP | 2015-113527 | A | 6/2015 |

OTHER PUBLICATIONS

International Search Report dated Jan. 20, 2017 in PCT/EP2016/074369 filed Oct. 11, 2016.

Chinese Office Action dated Oct. 23, 2020 in Chinese Application No. 201680067371.9 (with Computer Generated English Translation).

Notice of the Reason for Refusal dated May 14, 2019 in corresponding Japanese Patent Application No. 2018-525451 (with English translation)(13 pages).

Notice of the Reason for Refusal dated Jan. 21, 2020 in corresponding Japanese Patent Application No. 2018-525451 (with English translation)(12 pages).

Final Decision of Rejection dated Sep. 29, 2020 in corresponding Japanese Patent Application No. 2018-525451 (with English translation)(4 pages).

The First Office Action dated Jun. 24, 2019 in corresponding Chinese Patent Application No. 201680067371.9 (with English translation)(14 pages).

* cited by examiner

METHOD FOR MANUFACTURING AN AMORPHOUS METAL PART

CROSS-REFERENCE TO RELATED APPLICATIONS

This is a National phase Application in the United States of International Patent Application PCT/EP2016/074369 filed on Oct. 11, 2016 which claims priority on European patent application No. 15195197.7 filed on Nov. 18, 2015. The entire disclosure of the above patent applications are hereby incorporated by reference.

The present invention relates to a method for manufacturing a micromechanical component made of amorphous metal.

The technical field of the invention is the technical field of fine mechanics. More precisely, the invention belongs to the technical field of methods for manufacturing amorphous metal parts.

TECHNOLOGICAL BACKGROUND

Various methods are known for making micromechanical components. In fact, the latter may be made by micromachining or die stamping or by injection molding.

The use of methods of micromachining or of die stamping may also be envisaged for making amorphous metal parts.

However, an advantageous solution consists of casting the amorphous metal part directly, so that the final geometry, or a geometry close to the final geometry, requiring little finishing, is obtained by casting. The absence of a crystalline structure means that the properties of the amorphous metal part (in particular the mechanical properties, hardness and polishability) do not depend on the method of manufacture. This is a major advantage relative to the traditional polycrystalline metals, for which the raw castings have lower properties compared to forgings.

However, there are certain drawbacks when making micromechanical components with very small thicknesses (0.5 to 2 mm).

A first problem arises from the cooling of the mold. This drawback may comprise two aspects. A first aspect is that cooling must not be too slow, as there is then a risk of partial or complete crystallization and therefore loss of the properties of amorphous metals. For certain micromechanical components or certain packaging components, the presence of a single crystallite may be prohibitive for reasons of mechanical properties or visual appearance, since such crystallites will inevitably become visible during the finishing steps. It is therefore essential to have sufficiently rapid cooling during casting to guarantee that the part is amorphous. For this reason, the molds are made of metal, for example of steel or copper, allowing rapid abstraction of heat. Depending on the capacity of the selected alloy to become amorphous, with this method it is possible to obtain parts with a thickness of the order of 10 mm.

The second aspect to consider arises because cooling must not be too quick, as there is a risk of solidification before the mold cavity is completely filled. Now, with molds made of metal such as copper or steel, the thermal energy is quickly dispersed, leading to a risk of premature solidification. These two contradictory aspects mean the following compromise: the thickness of the castings must be neither too small (risk of solidification before complete filling of the cavity), nor too great (risk of crystallization). That is why this method is conventionally limited to parts with a thickness between about 2 and 10 mm.

A second drawback is a problem of forming. This problem of forming arises from the small size of the mold and of the cavity for the micromechanical component being made. For certain geometries, especially recessed geometries, which cannot be ejected from the mold, it may be necessary to add inserts in the mold, which must be removed after forming, and are lost. For complex shapes, the cost of these inserts and of the additional operations associated with them may become very high, making the method unusable industrially.

Another advantageous solution consists of making use of the forming properties of amorphous metals. In fact, amorphous metals have the particular characteristic of softening while remaining amorphous in a given temperature range [Tg−Tx] for each alloy, which is not very high, as these temperatures Tg and Tx are not very high. This then allows fine and precise geometries to be reproduced very accurately as the viscosity of the alloy decreases considerably and it can easily be deformed so as to reproduce all the details of a mold.

However, for making micromechanical components with very small thicknesses (0.5 to 2 mm), production of suitable molds is also very complex and presents the same limitations as in casting.

Moreover, at a temperature between Tg and Tx, there is limited time available before the alloy undergoes crystallization. If the geometry has many complex aspects with small thicknesses, the time required for complete filling of the mold may be greater than the time available, leading to partial or complete crystallization of the part and loss of its mechanical properties in particular.

A similar technique that is known is LIGA technology. LIGA consists of three main processing steps; lithography, electroforming and molding. There are two main LIGA manufacturing technologies, the X-ray LIGA technique, which uses X-rays produced by a synchrotron to create structures having a high aspect ratio, and the UV LIGA technique, a more accessible method that uses ultraviolet light to create structures having low aspect ratios.

The notable features of LIGA structures manufactured by the X-ray method comprise:

- high aspect ratios, of the order of 100:1;
- parallel side walls with a flank angle of the order of 89.95°;
- smooth side walls with $\delta$=10 nm, suitable for optical mirrors;
- structural heights from tens of micrometers to a few millimeters;
- structural details of the order of micrometers over distances of centimeters.

X-ray LIGA is a microengineering manufacturing technique developed at the beginning of the 1980s. In this method, a photoresistive polymer that is sensitive to X-rays, typically PMMA (poly(methyl methacrylate)), bound to an electrically conducting substrate, is exposed to parallel beams of high-energy X-rays from a synchrotron radiation source through a mask partly covered with an X-ray absorbing material. Chemical removal of the exposed (or unexposed) areas of the photoresistive polymer allows a three-dimensional structure to be obtained, which can be filled by electrodeposition of metal. The resin is removed chemically to produce a metal mold insert. The mold insert can be used for producing polymer or ceramic parts by injection molding.

The main advantage of the LIGA technique is the accuracy obtained using X-ray lithography (DXRL). This technique can produce microstructures having high aspect ratios and great accuracy, to be manufactured in a variety of materials (metals, plastics and ceramics).

The UV LIGA technique uses an inexpensive source of ultraviolet light, such as a mercury lamp, for exposing a photoresistive polymer, typically SU-8. Since heating and transmission are not a problem in optical masks, a simple chromium mask may be substituted for the sophisticated X-ray mask technique. These simplifications make the UV LIGA technique much less expensive and more accessible than its X-ray homolog. However, the UV LIGA technique is not as effective for producing precision molds and is therefore used when costs must be kept low and when very high aspect ratios are not required.

The drawback of such a method is that it is does not allow simple production of three-dimensional parts. It is in fact possible to manufacture three-dimensional parts by the LIGA method but it requires several successive iterations of photolithography and electrodeposition.

Moreover, the LIGA method presents a problem regarding the choice of materials. Two materials are in fact required: a material for the substrate and a material that is to be deposited. The material for the substrate must be photostructurable, so that plaster or zircon cannot be used. For the deposited material, it must be possible to deposit it by electroforming, so that metallic materials are the only conceivable materials. Now, such materials generally have thermal characteristics such that they ensure good thermal dissipation and therefore good cooling. For an amorphous metal alloy formed in the LIGA mold, this capacity for good dissipation of thermal energy would make hardening too quick and would therefore prevent good formation of the parts.

Finally, the LIGA method for making the mold is of a nature such as to limit the possible geometries, since a three-dimensional mold of this kind would require layer-by-layer manufacture.

SUMMARY OF THE INVENTION

The invention relates to a method for making a first part that overcomes the drawbacks of the prior art to provide a method for manufacturing a component made of a first metallic material, said first material being a material that can become at least partially amorphous, said method comprising the following steps:

a) providing a mold made of a second material, said mold comprising a cavity forming the negative of the component;

b) providing the first material and forming it in the cavity of said mold, said first material having undergone, at the latest at the time of said forming, treatment allowing it to become at least partially amorphous;

c) separating the component thus formed from the mold; characterized in that the second material forming the mold has a thermal effusivity from 250 to 2500 $J/K/m^2/s^{0.5}$.

In a first advantageous embodiment, step c) consists of dissolving said mold.

In a second advantageous embodiment, said first material is submitted to a temperature rise above its melting point, allowing it to lose any crystalline structure locally, said rise being followed by cooling to a temperature below its glass transition temperature, allowing said first material to become at least partially amorphous.

In a third advantageous embodiment, the forming step b) is simultaneous with treatment that makes said first material at least partially amorphous, by subjecting it to a temperature above its melting point followed by cooling to a temperature below its glass transition temperature allowing it to become at least partially amorphous, during a casting operation. This embodiment is wherein the critical cooling rate of the first material is below 10K/s.

In a fourth advantageous embodiment, forming is carried out by injection.

In a fifth advantageous embodiment, forming is carried out by centrifugal casting.

In another advantageous embodiment, the second material is zircon having an effusivity of 2300 $J/K/m^2/s^{0.5}$.

In another advantageous embodiment, the second material is of the plaster type consisting predominantly of gypsum and/or silica, having an effusivity between 250 and 1000 $J/K/m^2/s^{0.5}$.

In another advantageous embodiment, the first material has a critical cooling rate less than or equal to 10K/s.

The invention also relates to a component made of a first material, being a metallic material that can become at least partially amorphous, wherein it is manufactured using the method according to the invention.

The invention further relates to a watchmaking or jewelry component comprising the component according to the invention, said component is selected from the list comprising a caseband, a bezel, a bracelet link, a wheel, a hand, a crown wheel, pallets or an escapement system balance wheel, a tourbillon cage, a ring, a cuff link or an earring or a pendant.

BRIEF DESCRIPTION OF THE FIGURES

The aims, advantages and features of the method for making a first part according to the present invention will become clearer in the following detailed description of at least one embodiment of the invention given purely as a nonlimiting example and illustrated by the appended drawings, in which.

DETAILED DESCRIPTION

Figure 1:
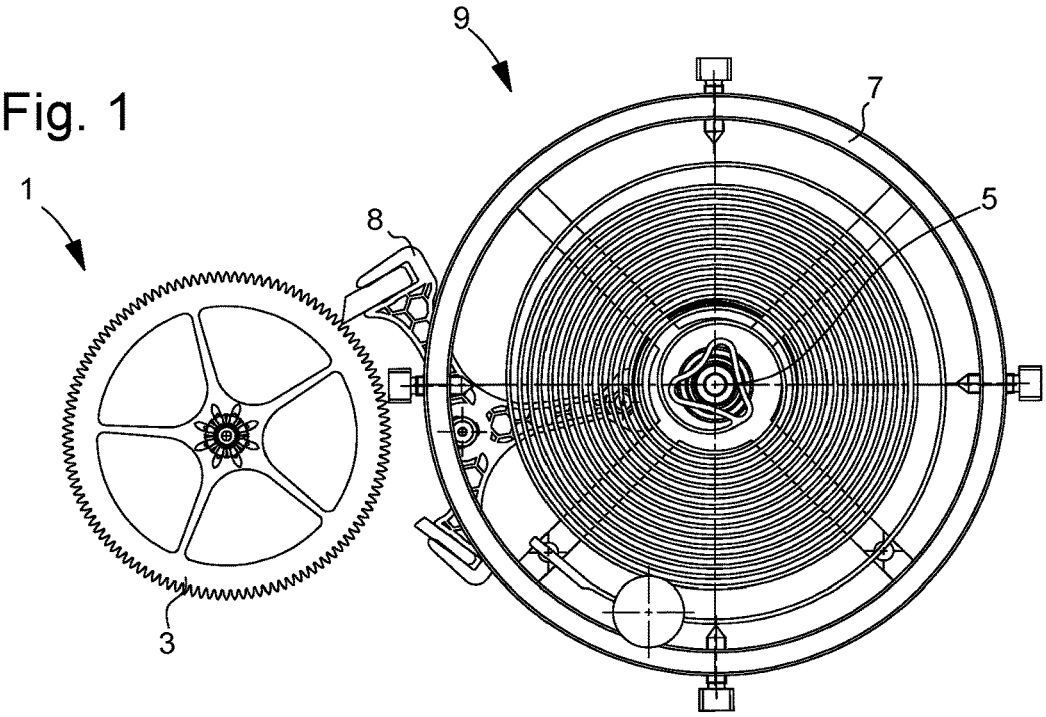
FIGS. 1 to 6 represent schematically the steps of the method according to the present invention.

FIGS. 1 to 6 show the various steps of the method for making a watch or jewelry component 1 also called first part 1 according to the present invention. This first part 1 is made of a first material. This first part 1 may be a covering part such as a caseband, a bezel, a bracelet link, a ring, cuff links or earrings or a pendant or a functional part such as a wheel 3, a hand, a crown wheel, pallets 5 or a balance wheel 7 of an escapement system 9, a tourbillon cage.

The first material is advantageously an at least partially amorphous material. More particularly, the material is metallic, meaning that it comprises at least one metallic element or metalloid in a proportion of at least 50 wt %. The first material may be a homogeneous metal alloy or an at least partially or completely amorphous metal. The first material is thus selected to be able to lose any crystalline structure locally during a temperature rise above its melting point followed by sufficiently rapid cooling to a temperature below its glass transition temperature, allowing it to become at least partially amorphous. The metallic element may or may not be precious.

Figure 2:
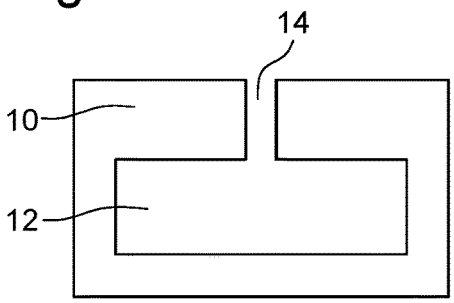

The first step, shown in FIG. 2, consists of providing a mold 10. This mold 10 has a cavity 12 that is the negative of the part 1 to be made. Here it is a so-called lost-wax mold. This type of mold consists of a mold 10 made of a material that can be destroyed or dissolved after use to release said part. The advantage of this type of mold is its ease of manufacture and of mold release, which is independent of the geometry of the cavity. It is thus easily possible to make cavities with complex and/or recessed geometries, without inserts. This mold may be obtained by covering a wax or resin pattern, obtained in its turn by injection, by additive manufacture, by machining, or by sculpture. This mold 10 comprises a channel 14 so that the molten metal can be poured in.

This mold 10 is thus made of a second material. Advantageously, the material of the mold is selected to have specific thermal properties. In fact, the aim here is to have a mold for lost wax casting that is made of a material allowing the amorphous material of the micromechanical component not to crystallize while completely filling the mold cavity.

Amorphous metals crystallize when, in a viscous or liquid state, they are not cooled sufficiently quickly to prevent the atoms forming a structure with one another. For a given alloy, this characteristic is defined by the critical cooling rate, Rc, i.e. the minimum cooling rate to be maintained between the melting point and the glass transition temperature in order to preserve an amorphous state of the material. Consequently, it becomes necessary to have a mold 10 made of a material that dissipates thermal energy well enough to guarantee a cooling rate R greater than Rc. Conventionally, foundry molds are made of steel or copper alloys in order to have a high value of R.

However, for parts with small dimensions or with fine, complex details, this capacity to dissipate thermal energy must not be too great. If this capacity is too great, there is a risk that the first material forming the first part will solidify before it completely fills the cavity 12 of the mold 10.

For this reason, the present invention proposes to use the criterion of thermal effusivity E in combination with Rc.

The thermal effusivity of a material characterizes its capacity for exchanging thermal energy with its surroundings. It is given by:

$$E=\sqrt{\lambda\rho c}$$

where:

λ: thermal conductivity of the material (in $W\cdot m^{-1}\cdot K^{-1}$)

ρ: density of the material (in $kg\cdot m^{-3}$)

c: heat capacity per unit mass of the material (in $J\cdot kg^{-1}\cdot K^{-1}$)

The effusivity is then measured in $J/K/m^2/s^{0.5}$.

This effusivity makes it possible, depending on the thickness of the first part to be made, to obtain cooling that guarantees an amorphous state of the material, i.e. R>Rc. In fact, if the effusivity criterion is large, the amorphous nature is linked to the thickness of the part to be produced. It will easily be understood that, for a given thickness, with a high effusivity there is a risk of solidification of the material before the latter can fill the whole of the mold, whereas if the effusivity is too low there is a risk of crystallization. According to the invention, the effusivity will be considered to be selected from a range from 250 to 2500 $J/K/m^2/s^{0.5}$. As an example of materials, the effusivity of materials of the plaster type is 250-1000 $J/K/m^2/s^{0.5}$ whereas for zircon it will be 2300 $J/K/m^2/s^{0.5}$.

With the effusivity characteristics selected for the invention, it is possible to obtain a first part having a thickness of 0.5 mm or more without solidification of the material before the cavity is filled completely. It is clear that components or portions of components with a thickness less than 0.5 mm may be correctly filled if they are point details and are of small dimensions.

Figure 3:
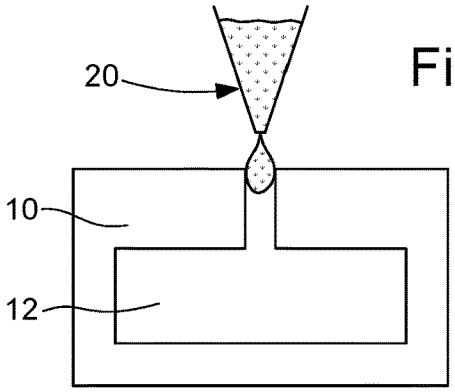
Figure 4:
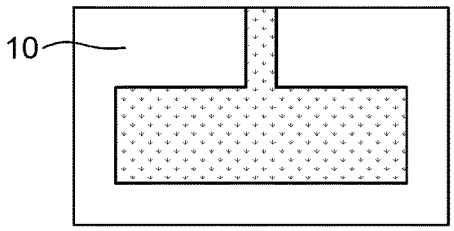

The second step consists of providing the first material, i.e. the material constituting the first part 1. Once provided with the material, the rest of this second step consists of forming it, as shown in FIGS. 3 and 4. A casting process is used for this.

Such a method consists of taking the first material that was provided in the third step but without having subjected it to a treatment making it at least partially amorphous and converting it to liquid form. This conversion to liquid form is effected by melting said first material in a pouring container 20.

Once the first material is in liquid form, it is poured into the mold cavity 2. When the mold cavity 2 is filled or at least partially filled, the first material is cooled so as to give it an amorphous form. According to the invention, cooling is effected by heat dissipation of mold 10, i.e. only utilizing the thermal characteristics of the material constituting the mold, in other words cooling is only effected owing to the effusivity of the mold and at only the mold/air interface to give the metallic material of the component an amorphous or at least partially amorphous character. Cooling is therefore accomplished without using any quenching medium other than the air or a gas, for example helium.

As a reminder, the material constituting the mold 10 will be selected to have an effusivity in a range from 250 to 2500 $J/K/m^2/s^{0.5}$, this thermal effusivity of a material being its capacity to exchange thermal energy with its surroundings. Thus, the higher the effusivity, the greater the cooling will be, at equivalent thickness.

With these values of effusivity, the cooling rate R is low relative to the metal molds used conventionally. For comparison, the effusivity of steel is greater than 10 000 $J/K/m^2/s^{0.5}$ and of copper greater than 35 000 $J/K/m^2/s^{0.5}$. For this reason, it is necessary to use a first material having a low critical cooling rate Rc in order to guarantee an amorphous or partially amorphous state of the part to be made. This critical cooling rate Rc will be below 15 K/s. Alloys used are for example given by the compositions Zr58.5Cu15.6Ni12.8Al10.3Nb2.8 (Rc=10K/s), Zr41.2Ti13.8Cu12.5Ni10Be22.5 (Rc=1.4K/s) or else Pd43Cu27Ni10P20 (Rc=0.10K/s). Other alloys forming the first material may be for example (composition in at %): Pd43Cu27Ni10P20, Pt57.5Cu14.7Ni5.3P22.5, Zr52.5Ti12.5Cu15.9Ni14.6Al12.5Ag2, Zr52.5Nb2.5Cu15.9Ni14.6Al12.5Ag2, Zr56Ti2Cu22.5Ag4.5Fe5Al10, Zr56Nb2Cu22.5Ag4.5Fe5Al10, Zr61Cu17.5Ni10Al7.5Ti2Nb2, and Zr44Ti11Cu9.8Ni10.2Be25. It will therefore be understood that a mold used in the present invention cannot be made of metallic material.

With the effusivity characteristics selected for the invention, it is thus possible to obtain a first amorphous metal part having a thickness between 0.5 mm and 1.4 mm, it being understood, as explained above, that details with smaller thickness can be made if they are point details, limited in size. Similarly, parts or portions of parts with thickness above 1.4 mm may be produced without crystallization if they are regarded as point details with small dimensions.

One advantage of casting a metal or alloy capable of being amorphous is to have a low melting point. In fact, the melting points of the metals or alloys capable of having an amorphous form are generally two to three times lower than those of the conventional alloys when considering compositions of identical types. For example, the melting point of the alloy Zr41.2Ti13.8Cu12.5Ni10Be22.5 is 750° C., compared to 1500-1700° C. for the crystalline alloys based on zirconium Zr and titanium Ti. This makes it possible to avoid damaging the mold.

Another advantage is that solidification shrinkage, for an amorphous metal, is very low, less than 1%, relative to shrinkage of 5 to 7% for a crystalline metal. This advantage makes it possible to use the casting principle without fear of surface defects or notable changes of dimensions that would result from said shrinkage.

Another advantage is that the mechanical properties and polishability of the amorphous metals do not depend on the method of manufacture provided they are amorphous. Thus, parts obtained by casting will have the same properties as forged, machined, or hot-formed parts, which is a major advantage relative to the crystalline metals, whose properties are strongly dependent on the crystalline structure, itself connected with the history of the method of production of the part.

In a first alternative, casting may be of the gravity type. In said casting, the metal fills the mold under the effect of gravity.

In a second alternative, casting may be of the centrifugal type. This centrifugal casting uses the principle of rapidly rotating the mold. The molten metal poured in adheres to the wall by centrifugal force and solidifies. This technique allows centrifugation and pressure on the material, which causes degassing and expels the impurities contained in the bath of molten metal to the exterior. Smaller cavities can be filled, compared to simple gravity casting.

In a third alternative, casting may be of the type by injection. Said casting by injection uses the principle according to which the mold is filled owing to a piston, which applies a very high force to push the molten metal. This pushing then allows the molten metal to be introduced into the mold, giving better mold filling. In other alternatives, casting may be of the type by counter-gravity, by molding under pressure, or by vacuum casting.

Figure 5:
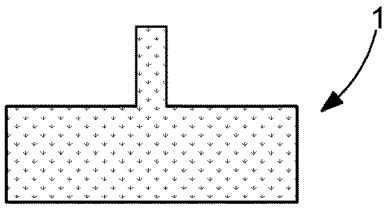

The third step, shown in FIG. 5, consists of separating the first part 1 from the mold 10. For this, the mold 10, in which the amorphous metal has been overmolded to form the first part 1, is destroyed using a high-pressure water jet, by dissolving in water or in a chemical solution, or by mechanical removal. When a chemical solution is used, it is selected for attacking the mold 10 specifically. In fact, the aim of this step is to dissolve the negative 1 without dissolving the first part 5 consisting of amorphous metal. For example, in the case of a mold made of plaster with a phosphated binder, a solution of hydrofluoric acid is used for dissolving the mold. The final result is then production of the first amorphous metal part.

Figure 6:
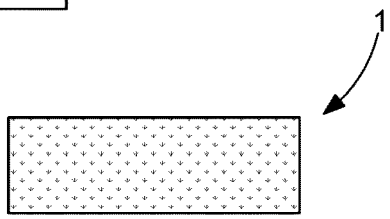

Next, the surplus material is removed mechanically or chemically as represented in FIG. 6.

It will be understood that various modifications and/or improvements and/or combinations that are obvious to a person skilled in the art may be applied to the various embodiments of the invention presented above while remaining within the scope of the invention as defined by the accompanying claims.

It will also be understood that the first step consisting of providing the negative 1 may also comprise preparing said negative. In fact, it is possible to decorate the negative 1 so that surface finishes can be produced directly on the first part. These surface finishes may be damaskeening, beaded, spiral diamond decoration or satin finish.

The invention claimed is:

1. A method for manufacturing a component made of a first material, the first material being a metallic material that can become at least partially amorphous, the method comprising:

a) providing a mold made of a second material, the mold comprising a cavity forming a negative of the component;

b) providing the first material and forming the first material in the cavity of the mold, the forming including treatment allowing the first material to become at least partially amorphous;

c) separating the component thus formed from the mold;

wherein the second material forming the mold has a thermal effusivity from 250 to 2500 $J/K/m^2/s^{0.5}$, and wherein the treatment allowing the first material to become at least partially amorphous comprises cooling, which is only accomplished owing to effusivity of the mold and only at a mold/gas interface.

2. The method of manufacture as claimed in claim 1, wherein c) dissolves the mold.

3. The method of manufacture as claimed in claim 1, wherein the first material is submitted to a temperature rise above its melting point, allowing the first material to lose any crystalline structure locally, the rise being followed by cooling to a temperature below its glass transition temperature allowing the first material to become at least partially amorphous, the first material having a critical cooling rate below 15 K/s.

4. The method of manufacture as claimed in claim 1, wherein the first material has a critical cooling rate less than or equal to 10K/s.

5. The method of manufacture as claimed in claim 1, wherein the forming b) is simultaneous with treatment making the first material at least partially amorphous, by subjecting the first material to a temperature above its melting point followed by cooling to a temperature below its glass transition temperature allowing the first material to become at least partially amorphous, during a casting operation.

6. The method of manufacture as claimed in claim 1, wherein the forming takes place by injection.

7. The method of manufacture as claimed in claim 1, wherein the forming takes place by centrifugal casting.

8. The method of manufacture as claimed in claim 1, wherein the second material is zircon having an effusivity of 2300 $J/K/m^2/s^{0.5}$.

9. The method of manufacture as claimed in claim 1, wherein the second material is a plaster consisting predominantly of gypsum and/or silica, having an effusivity between 250 and 1000 $J/K/m^2/s^{0.5}$.

* * * * *